US005232401A

United States Patent [19]

Fujita et al.

[11] Patent Number: 5,232,401

[45] Date of Patent: Aug. 3, 1993

[54] AIR SUPPLYING APPARATUS

[75] Inventors: Tsutomu Fujita; Akira Sueda; Masao Kimura; Hitoshi Ura; Yotsuo Mizunuma, all of Tokyo; Misao Osawa, Yamato, all of Japan

[73] Assignees: Kawasaki Steel Corporation, Hoygo; Hirayama Setsubi Co., Ltd., Kanagawa, both of Japan

[21] Appl. No.: 871,109

[22] Filed: Apr. 20, 1992

[30] Foreign Application Priority Data

Apr. 23, 1991 [JP] Japan ..... 3-091901
Nov. 14, 1991 [JP] Japan ..... 3-298648
Nov. 26, 1991 [JP] Japan ..... 3-310586

[51] Int. Cl.[5] ..... F24F 13/06
[52] U.S. Cl. ..... 454/187; 454/296
[58] Field of Search ..... 454/52, 186, 187, 188, 454/190, 191, 192, 284, 296, 297

[56] References Cited

U.S. PATENT DOCUMENTS 3,168,030 2/1965 Wilhelmsson et al. ..... 454/52
3,170,385 2/1965 Tompkins et al. ..... 454/191
3,251,289 5/1966 Mariner ..... 454/296
3,332,334 7/1967 Melzer ..... 454/188
3,387,551 6/1968 Hughes ..... 454/188 X
3,719,136 3/1973 Criddle ..... 454/187
3,726,203 4/1973 Lindestrom ..... 454/187 X
3,744,724 7/1973 Caille ..... 454/188 X
4,700,688 10/1987 Searcy et al. ..... 454/188 X
4,790,080 12/1988 Detzer et al. ..... 454/187 X
4,854,224 8/1989 Hirayama ..... 454/187

FOREIGN PATENT DOCUMENTS 59-44538 3/1984 Japan .

*Primary Examiner*—Harold Joyce
*Attorney, Agent, or Firm*—Oliff & Berridge

[57] ABSTRACT

An air supplying apparatus for supplying a clean room with air having a conditioned cleanliness, temperature and/or humidity includes an air control unit for discharging the controlled air, and an air outlet duct connected to an air outlet of the air control unit so as to receive the conditioned air from the air control unit through an opening which opens in a direction different from the direction of flow of air through the air control unit. The air outlet duct is formed from one or more perforated sheets having a multiplicity of air outlet apertures. The cross-sectional area of the air passage formed in the air outlet duct preferably progressively decreases towards the downstream end of the duct. A joint duct, which guides air in a direction different from the directions of flow of air through the air control unit and through the air outlet duct, may be connected between the air control unit and the air outlet duct.

8 Claims, 7 Drawing Sheets

AIR SUPPLYING APPARATUS

BACKGROUND OF THE INVENTION

1. Field of the Invention

The present invention relates to air supplying apparatus which condition air in terms of cleanliness, temperature and humidity and which supply the controlled (conditioned) air into a room.

2. Description of Related Art

Air supplying apparatus are used for the purpose of supplying clean air, or clean air with controlled temperature and humidity into rooms which are in need of such conditioned air. Rooms requiring conditioned air include, e.g., rooms in which semiconductors, electronic devices and precision devices are produced, rooms in which pharmaceutical products or foodstuffs are produced, hospital operating rooms, and so forth. (Such rooms will be generally referred to as "clean rooms", hereafter.)

An air cleaning system, which is one type of such air supplying apparatus, has an air recirculating blower and a filter which are disposed outside a room, and air supply pipes installed in the ceiling wall and side walls of the room. The supply pipes have outlet openings which open in the surfaces of such walls, so that filtered air blown by the blower is supplied into the room through the outlet openings.

This type of system can supply air over a wide area in the room at a sufficiently large flow rate, but requires much cost and labor to install the air supply pipes, which must be embedded in the ceiling and side walls of the room and which open through the inner surfaces of the ceiling and side walls. In particular, introduction of this system to a room of an existing building requires a long construction period, as well as a huge cost.

An air cleaning unit has been known in which an air recirculating blower and a filter are assembled together in a casing which is provided at its top and bottom ends with a clean air discharge opening and a room air suction opening respectively. It is possible to clean the air in a room with such an air cleaning unit. This unit, however, can supply clean air only to limited portions of the room, and is unable to recirculate air at a sufficiently large rate to clean an entire room. With such air cleaning units, therefore, it is not possible to clean the air in a room to a desired extent.

In order to overcome these problems, Japanese Laid-Open Patent No. 59-44538 proposes an improved air cleaning unit which employs a columnar structure equipped with an air suction opening and an air recirculating blower. A duct of a specific cross-sectional shape is provided on the upper side of this columnar structure so as to extend along the lower surface of a ceiling. Air outlets are provided in the duct. A plurality of such air cleaning units are used in a room having a large volume. In this known air cleaning unit, however, no specific consideration has been given to the pattern of distribution of the air discharged from the air outlets. Consequently, the cleaned air cannot be supplied uniformly over the entire area of the room, which undesirably results in local concentrations or thinning of the controlled air, causing the cleanliness of the air in the room to be locally degraded, or the temperature and/or humidity to be deviated from the target level at local regions in the room.

This type of air cleaning unit also poses a problem in that a considerably high level of noise is generated during its operation from, for example, the motor and blades of the blower. Consequently, noise limits are often exceeded in rooms where silence must be kept, e.g., hospital operating rooms. This problem is serious particularly when a plurality of such air cleaning units are used to cover a large space in a large room having a large internal volume.

OBJECTS AND SUMMARY OF THE INVENTION

Accordingly, an object of the present invention is to provide an air supplying apparatus which is capable of uniformly discharging air from its air outlets at a reduced level of noise as compared with known air cleaning systems or units.

It is another object of the present invention to provide an air supplying apparatus which is capable of uniformly conditioning the air in a room, without any local concentrations of unconditioned air resulting.

To achieve the foregoing and other objects, and to overcome the shortcomings discussed above, according to the present invention there is provided an air supplying apparatus comprising: an air control unit for discharging air conditioned to a desired state; and an air discharging duct connected to an air outlet of the air control unit so as to receive the conditioned air from the air control unit through an opening which opens in a direction different from the direction of flow of air through the air control unit, the air discharge duct being formed from at least one perforated sheet having a multiplicity of air outlet apertures.

BRIEF DESCRIPTION OF THE DRAWINGS

The invention will be described in detail with reference to the following drawings in which like reference numerals refer to like elements, and wherein.

DETAILED DESCRIPTION OF THE PREFERRED EMBODIMENTS

Figure 1:
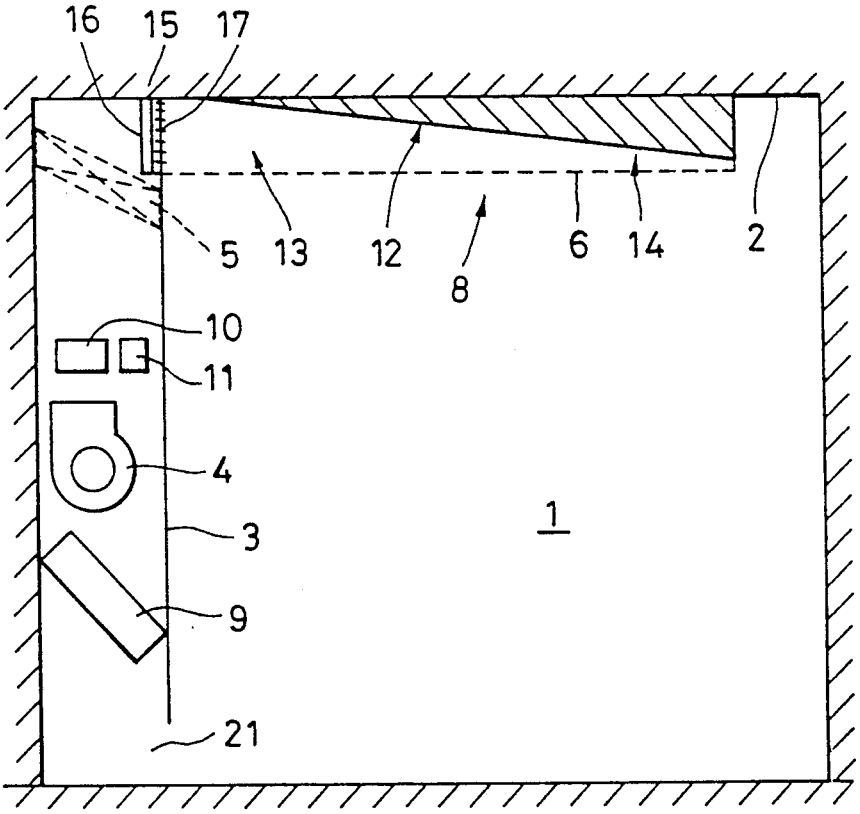
FIG. 1 is a schematic illustration of an air supplying apparatus installed in a clean room.

Referring to FIG. 1, which is a schematic illustration of an air supplying apparatus according to one embodiment of the present invention installed in a clean room 1, the air supplying apparatus include an air control unit 3, and an air outlet duct 8 which is connected to extend in a direction different from the direction of the flow of air through the air control unit 3 and which distributes the cleaned air into the room 1. That is, in FIG. 1, air flows in the vertical direction through air control unit 3, while air flows in the horizontal direction through air outlet duct 8.

The air control unit 3 includes an air inlet unit 21, a blower 4, a high-efficiency particulate air filter 5 capable of removing dust and other contaminants from the air, a cooler 9 for cooling the air, a heater 10 for heating the air and a humidifier 11 for controlling the humidity of the air. The various components can be operated with blower 4 individually or in combination.

The air outlet duct 8 connected to the air control unit 3 is adapted to deflect the air flowing through the air control unit 3, such that the air flows, for example, in parallel with the ceiling 2 of the room. The portions of the air outlet duct 8 other than the portion contacting the ceiling 2 are made of one or more perforated sheets 6, e.g., one or more punched metal sheets, having a multiplicity of pores serving as air outlet apertures 7. Preferably the air outlet apparatus 7 are evenly distributed over the entire surface of perforated sheet 6.

Figure 2A:
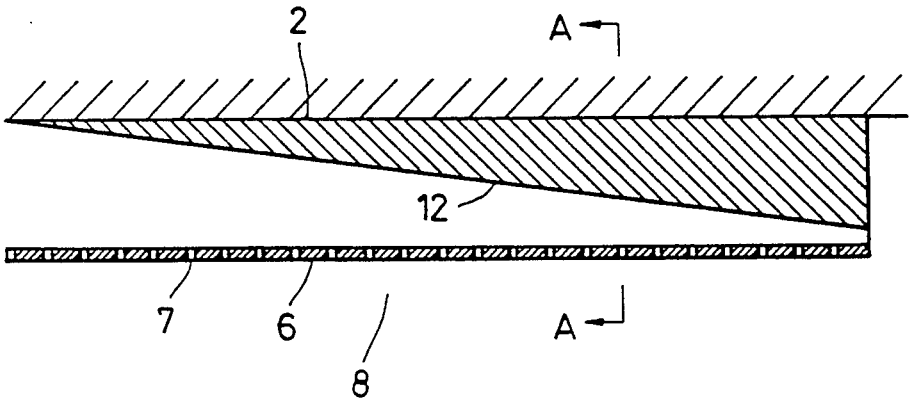
FIG. 2A is a cross-sectional side elevational view of an air outlet duct.
Figure 2B:
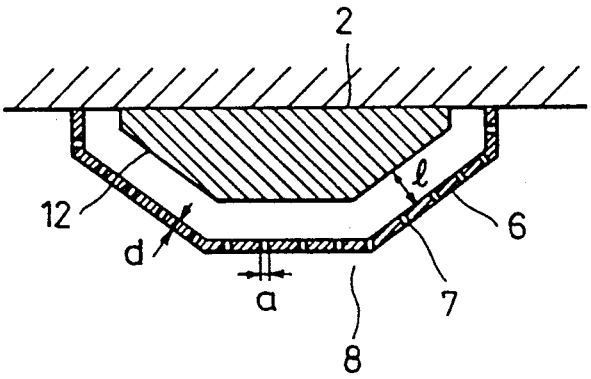
FIG. 2B is a cross-sectional view taken along the line A—A of FIG. 2A.

The air outlet duct 8 has a cross-sectional shape similar to that of a ship's hull as shown in FIG. 2B and is elongated so as to extend along the ceiling as shown in FIG. 2A. The cross-sectional shape of air outlet duct 8 shown in FIG. 2B is only illustrative; the air outlet duct can have any other suitable cross-sectional shape such as, for example, a rectangular, semi-circular or inverse trapezoidal form, provided that the duct can uniformly supply air over as wide an area as possible in the room.

As will be seen from FIG. 2A, the cross-sectional area of the space inside air outlet duct 8, which is available as the air passage, is progressively decreased from the upstream end region 13 (inlet) towards the downstream end region 14 as viewed in the direction of the flow of air.

As one means for progressively decreasing the cross-sectional area of the air passage, the cross-sectional area of the air outlet duct is progressively decreased from upstream end 13 towards downstream end 14 linearly or in a stepped manner. Alternatively, a flow passage adjusting member 12 can be installed in the air outlet duct so as to progressively decrease the cross-sectional area of the passage, as shown in FIG. 1 and 2A.

The total head of the air in duct 8, which is the sum of the dynamic pressure $V^2/2$ and the static pressure, is substantially equal over the entire region of the duct, and the rate of discharge of the air depends mainly on the static pressure in the duct. This means that a uniform distribution of air discharge rate over the entire area of the duct is obtainable by developing a substantially equal flow velocity over the entire length of duct 8. Assuming that the cross-sectional area of the air flow passage is uniform (constant) over the entire length of duct 8, the static pressure is lower at the upstream side 13 where the flow velocity is large due to large air flow rate as compared with the downstream portion 14 where the flow velocity is small due to small air flow rate. Conversely, in the downstream portion 14 of the duct, the static pressure is increased due to small air flow rate as compared with the upstream portion 13. Therefore, when the cross-sectional area of the air passage in the duct is constant over the entire length of the duct, air is discharged at a greater rate in the downstream portion 14 than in the upstream portion 13. In the illustrated embodiment, however, this problem is obviated because the the cross-sectional area of the flow passage is progressively decreased towards the downstream end of the duct by the design of the duct or by the provision of the flow passage adjusting member 12 in the duct. Namely, in the illustrated embodiment, a substantially equal flow velocity v of air is obtained both at the upstream portion 13 and the downstream portion 14, so that a substantially uniform static pressure and, hence, a substantially uniform distribution of air discharge rate can be obtained over the entire length of duct 8.

In the illustrated embodiment, the distance $\lambda$ of the clearance between the perforated plate 6 forming the duct 8 and the opposing surface of the flow passage adjusting member 12 is maintained substantially constant across each cross-sectional portion of duct 8, so that a substantially equal air discharge rate can be obtained in all directions at each cross-section of duct 8. This arrangement, in combination with the progressive reduction in the cross-sectional area of the air passage mentioned above, contributes to the realization of a uniform distribution of the controlled air throughout the clean room 1.

Figure 4:
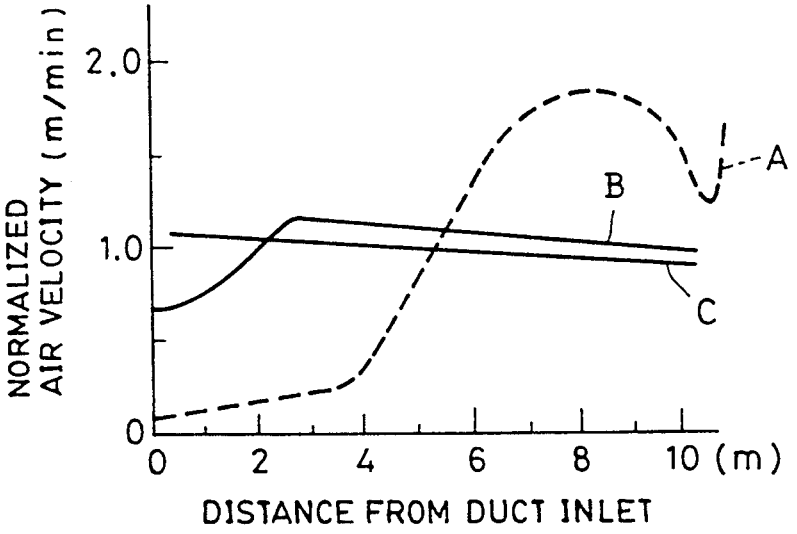
FIG. 4 is a graph showing air blow-out velocity along the air outlet duct in relation to the distance from the inlet of the air outlet duct.

FIG. 4 is a diagram showing the distribution of velocity of the air discharged from duct 8 in relation to the distance from the duct inlet, i.e., the upstream end 13 of duct 8. Curve A shows the flow velocity distribution as obtained when the cross-sectional area of the flow passage in the duct is constant over the entire length of duct 8, while curve B shows the flow velocity as observed when the cross-sectional area of the flow passage is progressively decreased towards the downstream end 14 of duct 8. It will be seen that the progressive reduction of the cross-sectional area of the flow passage greatly contributes to the realization of uniform distribution of air discharge rates.

A test was conducted in which the time required for the air in the clean room 1 of FIG. 1 to be cleaned to a cleanliness degree of class 100 (Federal Standard 2090) was measured for both a duct having a constant cross-sectional area of the flow passage, and a duct having a progressively decreasing cross-sectional area of flow passage. The time required for cleaning to class 100 was measured to be 30 minutes when the duct having a constant cross-sectional area flow passage was used, and 10 minutes when the duct having a progressively decreasing cross-sectional area flow passage was used. It is thus possible to shorten the time required for cleaning the air in a room, by evenly distributing the cleaned air throughout the space in the room.

A description will now be given of a modification which employs a flow adjusting device 15 shown in FIG. 1.

Figure 3A:
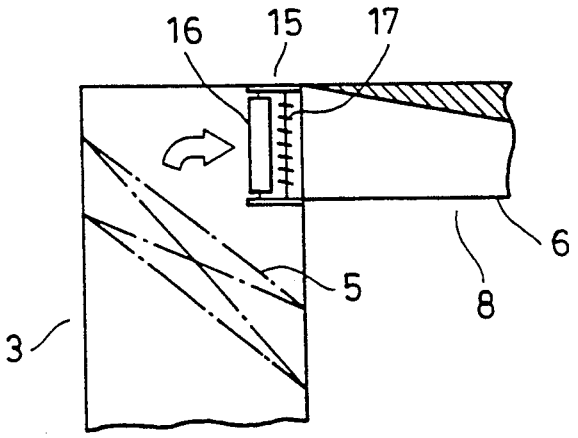
FIG. 3A is a side elevational view of a flow adjusting device.
Figure 3B:
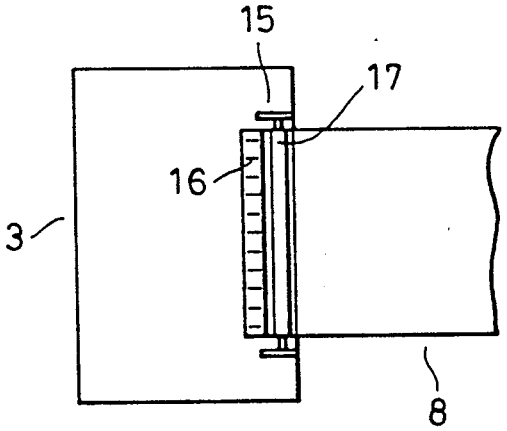
FIG. 3B is an overhead view of the flow adjusting device.

FIG. 3A is a schematic side elevational view of the flow adjusting device 15, while FIG. 3B is a schematic overhead view of the same.

The flow adjusting device 15 is disposed at the air inlet of duct 8 which is installed in the clean room 1 shown in FIG. 1. The flow adjusting device 15 includes vertical blades 16 and horizontal blades 17, both having an air foil cross-section and being movably mounted so as to enable the direction of the flowing air to be adjusted both vertically and horizontally. Blades 16 and 17 are supported by respective shafts through friction. The level of friction is large enough to hold the blades in position against the pressure of the flowing air but is small enough to permit an easy rotation of the blades on the shafts by manual force.

When measurement of the cleaned air distribution in the clean room shows that there is a local concentration of the cleaned air in the room, the user can adjust the directions of blades 16 and 17 so as to adjust the direction of the air entering duct 8, thereby minimizing local concentration of cleaned air in the clean room.

A certain degree of offset or local concentration can occur in the flow of air emerging from filter 5 and entering duct 8. In other words, the flow velocity of air may not be uniform in a cross-sectional plane at the inlet of duct 8. Therefore, a nonuniform distribution of air discharge rate may be undesirably created in the inlet or upstream portion 13 of duct 8, as shown by the curve B in FIG. 4. This problem, however, can be overcome by the provision of the flow adjusting device 15 which employs two types of blades 16, 17 for adjusting the flow of air both in the vertical and horizontal directions so as to develop a substantially uniform distribution of the air flow rate at the entrance of duct 8. It is therefore possible to obtain a substantially uniform distribution of air discharge rate in the upstream portion 13 of the duct 8.

In FIG. 4, curve C shows the air discharge rate distribution as observed when both the flow passage adjusting member 12 and the flow adjusting device 15 are simultaneously used. It will be seen that a further uniform air discharge rate distribution is attained by the combined use of the flow passage adjusting member 12 (flow passage cross-section adjusting member) and the flow adjusting device 15 (flow direction adjusting device). Consequently, the cleaned air can be distributed throughout the space in the clean room with a greater degree of uniformity, thus offering a remarkable effect of cleaning air in the clean room.

As will be seen from FIGS. 2A and 2B, portions of the air outlet duct 8 other than the portion contacting ceiling 2 of the clean room are composed of one or more perforated sheets 6 (made from, for example, punched metal) each having a multiplicity of air outlet apertures 7. The diameter, a, of each air outlet aperture is determined in relation to the thickness, d, of the perforated sheet 6 so as to meet the condition of $d/a \geqq 1$. This condition ensures that the flow of the air is stabilized in each outlet aperture 7 so as to enable the air to be discharged in the direction of the axis of each aperture (i.e., in FIG. 1 straight down). If the diameter, a, does not meet the above-described condition, i.e., when the condition is such that $d/a < 1$, the flow of air exiting from each aperture inevitably has a flow component directed in the longitudinal direction of the duct 8. Consequently, the cleaned air discharged from outlet apertures 7 formed in the bottom wall of duct 8 are undesirably directed obliquely downward rather than being directed vertically, resulting in lack of uniformity in the distribution of the discharged air.

A description will now be given of another modification having a joint duct, with specific reference to FIG. 5. The air supplying apparatus shown in FIG. 5, installed in a clean room, has an air control unit 3 for discharging air which has been controlled to a desired degree of cleanliness, temperature and humidity, a joint duct 18 which is connected to the outlet end of the air control unit 3 and an air outlet duct 8 which is connected to the downstream end of the joint duct 18. The joint duct 18 can be connected to any desired side of the air control unit 3, depending on the geometrical form and size of the room. When the clean room has a large internal volume, it is possible to use two of these apparatus, such that the two apparatus are disposed to oppose each other.

The air flowing through the air control unit 3 is introduced into the joint duct 18, through an opening which opens in a direction different from the direction of flow of the air through the air control unit 3. The air then enters the air outlet duct 8 through an opening which opens in a direction different from the direction of flow of air through the joint duct 18.

Consequently, the air discharged from the air control unit 3 is repeatedly deflected as the air passes through the openings which are directed in different directions. In addition, the cross-sectional area of the air passage changes as the air flows from the air control unit 3 into the joint duct 18 and then into the outlet duct 8. Consequently, the noise energy propagating through the air is extinguished as a result of conversion from kinetic energy into thermal energy. Consequently, the level of noise is lowered each time the flow of air is deflected, whereby the noise level is lowered in the clean room.

Figure 6:
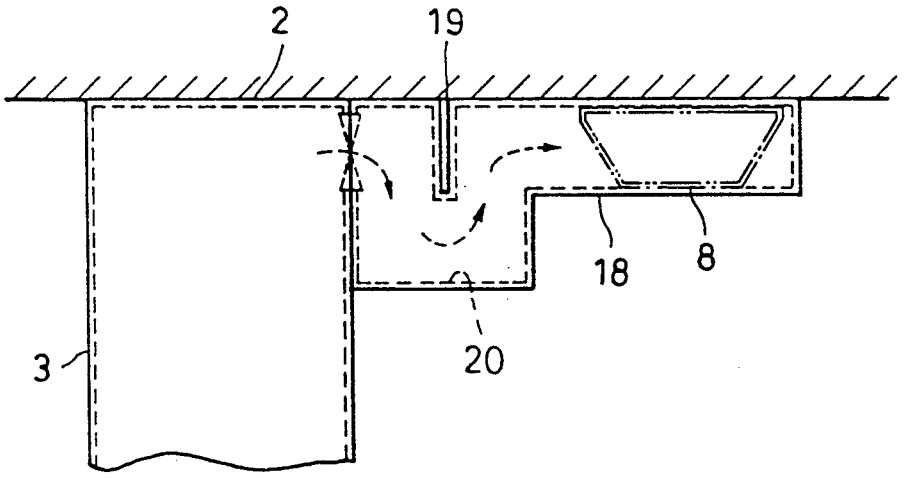
FIG. 6 is a cross-sectional side elevational view of an air supplying apparatus having a joint duct with an internal projection serving as a baffle member.

Another embodiment of the present invention will be described with reference to FIG. 6.

Figure 5:
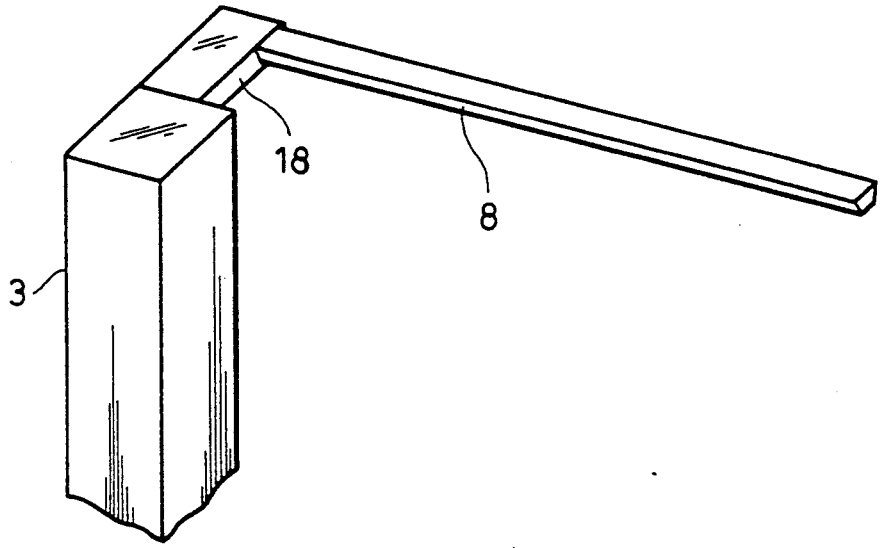
FIG. 5 is a perspective view of an air supplying apparatus having a joint duct.

As is the case of the apparatus shown in FIG. 5, the second embodiment of the air supplying apparatus of the present invention includes an air control unit 3, a joint duct 18 connected to the outlet end of air control unit 3 and an air outlet duct 8 connected to the downstream end of joint duct 18.

A tabular member 19 protrudes from a wall of joint duct 18 so as to project into the air passage. Tabular member 19 functions as a baffle plate which deflects air. Consequently, the air flowing through joint duct 18 experiences changes in the cross-sectional area of the flow passage, as well as flowing direction, so that the noise energy propagated through the flow of air is converted into thermal energy, thus attaining a remarkable reduction in the noise level within the clean room.

A further reduction in the noise level can be attained by lining the walls of the joint duct 18 with a sound absorbing material 20 which is, in this embodiment, an aluminum fiber mat of about 25 mm thick.

Figure 7:
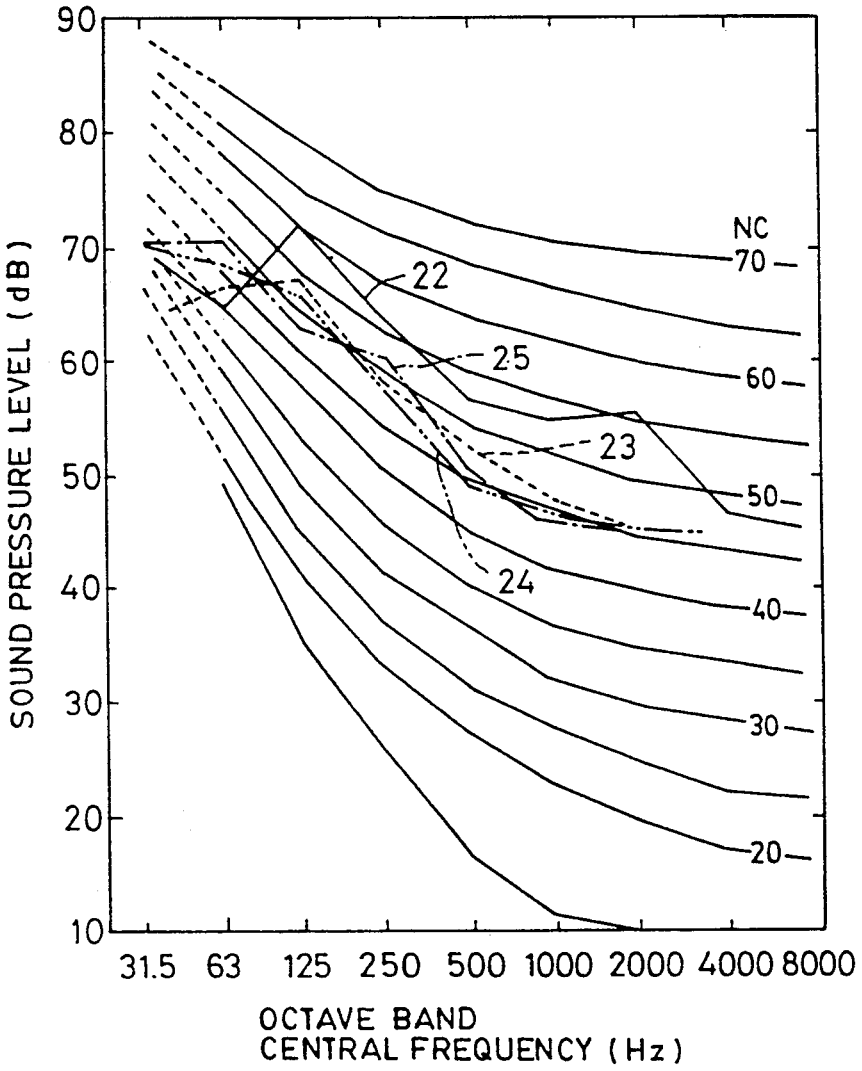
FIG. 7 is a graph showing the sound pressure levels of various air supplying apparatus.

With specific reference to FIG. 7, a description will now be given of the results of measurements of noise levels produced by various types of air supplying apparatus. More specifically, FIG. 7 shows the measurements of sound pressure levels as measured at the center of a room at a level about 1.2 m above the floor surface, when the blower motor 4 in the air control unit 3 was operated at a frequency of about 50 Hz. The measurement was conducted through octave band analysis. The axis represents the central frequency (Hz) of the octave band, while the ordinate axis represents the sound pressure level.

A solid-line curve 22 shows the values measured with a conventional air supplying apparatus. In this case, peaks of sound pressure were observed at almost all central frequency bands. The maximum sound pressure level was 61 dB (A). The NC value in the 125 Hz band exceeds 60.

A chain-line curve 23 shows the sound pressure levels as observed with the air supplying apparatus of the invention incorporating the joint duct 18. A two-dot-and-dash line 24 shows the sound pressure levels as observed when the joint duct 19 is provided with the tabular member 19 serving as a baffle plate. A one-dot-and-dash line curve 25 indicates the sound pressure levels as observed when the joint duct 18 is equipped both with the tabular member 19 and the sound absorbing lining 20. It will be seen that the noise level in the clean room can be appreciably reduced by using the air supplying apparatus of the present invention.

Figure 8:
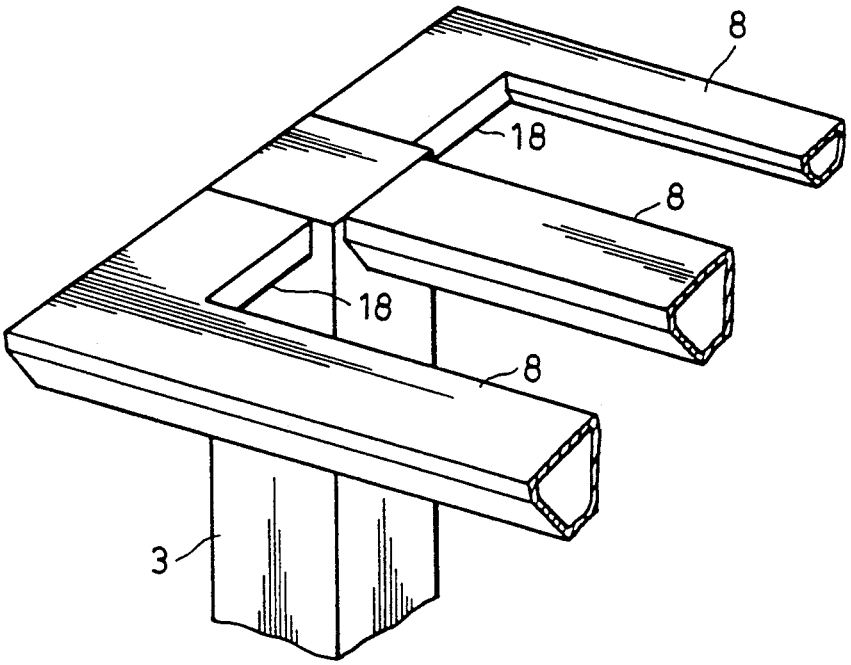
FIG. 8 is a perspective view of another embodiment of the air supplying apparatus in accordance with the present invention.

In the known air supplying apparatus, only one air discharge duct 8 is used for one air control unit 1. This means that when a plurality of air discharge ducts are to be employed, it is necessary to install plural air control units correspondingly in the clean room. FIG. 8 shows a modification of the air supplying apparatus in which three ducts 8 are connected to a single air control unit. By using this air supplying apparatus, it is possible to reduce the number of air control units to be installed so that the installation cost can be remarkably reduced. The reduction in the number of air control units also appreciably saves cost and time required for maintenance.

Although the modification shown in FIG. 8 has three air discharge ducts 8 connected to a single air control unit 3, any desired number of air discharge ducts, e.g., two, four or more, may be connected to the air control unit 3. The number of air discharge ducts 8, as well as the directions in which these ducts extend, may be determined in accordance with the shape of the room.

As will be understood from the foregoing description, according to the present invention, an air outlet duct is connected to an air control unit so as to guide the air in a direction different from the direction of flow of the air through the air control unit. The cross-sectional area of the air passage defined in the air outlet duct is progressively reduced towards the downstream end of the air outlet duct. In a preferred form of the invention, the duct is formed from one or more perforated sheets having a multiplicity of air outlet apertures, the diameter of which is controlled in relation to the thickness of the perforated sheet. In another preferred form, a joint duct is connected between the air control unit and the air outlet duct so as to realize a repeated change in the flowing direction of the cleaned air.

By virtue of these features, the air supplying apparatus of the present invention can create a uniform distribution of cleaned air throughout a clean room, while reducing the level of the noise, as well as the cost required for installation.

While this invention has been described in conjunction with specific embodiments thereof, it is evident that many alternatives, modifications and variations will be apparent to those skilled in the art. Accordingly, the preferred embodiments of the invention as set forth herein are intended to be illustrative, not limiting. Various changes may be made without departing from the spirit and scope of the invention as defined in the following claims.

What is claimed is:

1. An air supplying apparatus, comprising:

an air control unit for discharging air conditioned to a desired state; and an air outlet duct connected to an air outlet of said air control unit so as to receive the conditioned air from the air control unit through an opening which opens in a direction different from a direction of flow of air through said air control unit, said air outlet duct being disposed horizontally along a lower surface of a ceiling, wherein said air outlet duct is formed from at least one perforated sheet having a multiplicity of air outlet apertures formed in all portions of said sheet other than a portion where said air outlet duct is in contact with the ceiling, a cross-sectional area of an air passage defined by said air outlet duct progressively decreasing from an upstream end towards a downstream end of said air outlet duct, a plurality of movable flow passage adjusting blades for changing a direction of flow of the controlled air in vertical and horizontal directions disposed at an inlet end of said air outlet duct.

2. The air supplying apparatus according to claim 1, further comprising a flow passage adjusting member disposed in said air outlet duct so as to cause the progressive decrease in the cross-sectional area of said air flow passage, said flow passage adjusting member having a cross-sectional shape similar to the cross-sectional shape of said airflow passage so that constant gaps are maintained between said perforated sheet and said flow passage adjusting member across each cross-sectional portion of said airflow passage.

3. The air supplying apparatus according to claim 1, wherein said multiplicity of air outlet apertures each have a diameter, a, which is determined in relation to a thickness, d, of said at least one perforated sheet so as to meet the condition: $d/a \geqq 1$.

4. The air supplying apparatus according to claim 1, further comprising a joint duct connected between said air control unit and said air outlet duct, so as to enable control of the rate and direction of flow of the conditioned air, said joint duct having a plate disposed therein extending in a direction perpendicular to the flow of air in said air outlet duct so as to interrupt part of the air flowing in said air outlet duct.

5. The air supplying apparatus according to claim 2, further comprising a joint duct connected between said air control unit and said air outlet duct, so as to enable control of the rate and direction of flow of the conditioned air, said joint duct having a plate disposed therein extending in a direction perpendicular to the flow of air in said outlet duct so as to interrupt part of the air flowing in said air outlet duct.

6. The air supplying apparatus according to claim 3, further comprising a joint duct connected between said air control unit and said air outlet duct, so as to enable control of the rate and direction of flow of the conditioned air, said joint duct having a plate disposed therein extending in a direction perpendicular to the flow of air in said outlet duct so as to interrupt part of the air flowing in said air outlet duct.

7. The air supplying apparatus according to claim 3, wherein said perforated sheet is at least one metal sheet.

8. The air supplying apparatus according to claim 1, wherein said at least one perforated sheet defines walls of said air outlet duct which discharge the conditioned air downward, obliquely downward, and horizontally along the ceiling.

* * * * *